US005947793A

United States Patent [19]

Yamakawa

[11] Patent Number: 5,947,793

[45] Date of Patent: Sep. 7, 1999

[54] SELF-PROPELLING ROLLING TOY

[75] Inventor: Kazumi Yamakawa, Soka, Japan

[73] Assignee: Dah Yang Toy Industrial Co., Ltd., Tainan, Taiwan

[21] Appl. No.: 09/129,114

[22] Filed: Aug. 4, 1998

Related U.S. Application Data

[63] Continuation-in-part of application No. 09/001,161, Dec. 30, 1997, abandoned.

[51] Int. Cl.[6] ..... A63H 17/00

[52] U.S. Cl. ..... 446/431; 446/457

[58] Field of Search ..... 446/269, 396, 446/431, 433, 437, 457, 464

[56] References Cited

U.S. PATENT DOCUMENTS

| | | | |
|---|---|---|---|
| 4,471,567 | 9/1984 | Martin | 446/437 |
| 4,921,458 | 5/1990 | Greenwood | 446/269 |
| 4,927,401 | 5/1990 | Sonesson | 446/433 |
| 4,931,029 | 6/1990 | Hwang | 446/396 |
| 5,131,882 | 7/1992 | Kiyokane | 446/464 |
| 5,169,354 | 12/1992 | Norton et al. | 446/396 X |

*Primary Examiner*—Sam Rimell
*Attorney, Agent, or Firm*—Darby & Darby

[57] ABSTRACT

A self-propelling rolling toy includes a transparent spherical outer casing, a coupling rod provided in and coupled non-rotatably to the outer casing, a horizontal transmission shaft mounted rotatably in the outer casing, an inner body mounted rotatably on the shaft inside the outer casing, a clutch operable to lock selectively the inner body to the coupling rod, and a winding-type driving unit disposed in the inner body. The driving unit includes a spiral energy spring with an innermost end coupled to the shaft and an outermost end coupled to the inner body, a ratchet and pawl unit provided on the shaft, and a gear set which couples the ratchet and pawl unit and the coupling rod. The ratchet and pawl unit prevents rotation of the shaft from being transmitted to the coupling rod when the shaft is rotated in a first direction while the inner body is locked to the coupling rod to permit winding of the spring, and permits rotation of the shaft in an opposite second direction due to operating energy stored in the spring to be transferred to the outer casing while the inner body is unlocked from the coupling rod.

9 Claims, 5 Drawing Sheets

SELF-PROPELLING ROLLING TOY

CROSS REFERENCE TO RELATED APPLICATION

This application is a continuation-in-part (CIP) of U.S. patent application Ser. No. 09/001,161, filed on Dec. 30, 1997, abandoned the entire disclosure of which is incorporated herein by reference.

BACKGROUND OF THE INVENTION

1. Field of the Invention

The present invention relates to a self-propelling rolling toy, more particularly to a toy which has an inner body that is suspended in a transparent spherical outer casing, that is kept in a substantially upright orientation when the outer casing rolls on a ground surface, and that is rotated within the outer casing when rolling of the outer casing is resisted.

2. Description of the Related Art

A conventional self-propelling toy is usually provided with a transmission mechanism which includes a spiral torsion spring, a rotary operating member for winding the spiral torsion spring in order to store operating energy, and a gear set for transmitting the operating energy to moving parts, such as leg members, of the toy. The moving parts of the toy can thus be driven by the operating energy to move on a ground surface, such as to simulate a walking action. However, after being popular for years, the aforementioned walking-type toy has lost its appeal and has become less attractive to consumers.

In co-pending U.S. patent application Ser. No. 09/001,161, the Applicant disclosed a self-propelling rolling toy which includes an inner body suspended rotatably in a transparent spherical outer casing that is capable of rolling movement on a ground surface, a drive unit for driving rotation of the inner body in the outer casing, and clutch means operable to lock selectively the inner body to the outer casing. In use, the clutch means must be operated for a first time in order to lock the outer casing to the inner body to permit winding of a spiral energy spring, and for a second time in order to unlock the outer casing from the inner body to permit unwinding of the spiral energy spring and permit relative rotation between the inner body and the outer casing. It is noted that operation of the clutch means is somewhat difficult for a small child. Moreover, the structure of the clutch means is relatively complicated. It is thus desirable to provide a self-propelling rolling toy which includes clutch means that has a simplified structure and that is easier to operate, especially by a small child.

SUMMARY OF THE INVENTION

The main object of the present invention is to provide a self-propelling rolling toy of the aforementioned type which has a simplified structure and which is easy to operate.

Accordingly, the self-propelling rolling toy of the present invention includes a transparent spherical outer casing, a coupling rod, a horizontal transmission shaft, an inner body, clutch means and a winding-type driving unit. The coupling rod is provided in and is coupled non-rotatably to the outer casing. The horizontal transmission shaft is mounted rotatably in the outer casing along an axis of the outer casing. The transmission shaft has an operating end that is operable from an outer side of the outer casing. The inner body is mounted rotatably on the transmission shaft inside the outer casing. The clutch means is provided on the inner body and the coupling rod, and is operable to lock selectively the inner body to the coupling rod. The winding-type driving unit is disposed in the inner body, and includes a spiral energy spring which has an innermost end coupled to the transmission shaft and an outermost end coupled to the inner body, a ratchet and pawl unit provided on the transmission shaft, and a gear set which couples the ratchet and pawl unit and the coupling rod. The ratchet and pawl unit prevents rotation of the transmission shaft from being transmitted to the coupling rod when the operating end of the transmission shaft is rotated in a first direction while the clutch means locks the inner body to the coupling rod to permit winding of the spiral energy spring for storing operating energy. The ratchet and pawl unit permits rotation of the transmission shaft in a second direction opposite to the first direction due to the operating energy of the spiral energy spring to be transferred to the outer casing via the gear set and the coupling rod to result in rotation of the outer casing relative to the inner body and in rolling movement of the outer casing when the outer casing is placed on a ground surface while the clutch means unlocks the inner body from the coupling rod. Resistance to rotation of the outer casing relative to the inner body while the clutch means unlocks the inner body from the coupling rod results in rotation of the inner body in the outer casing about the transmission shaft due to the operating energy of the spiral energy spring.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
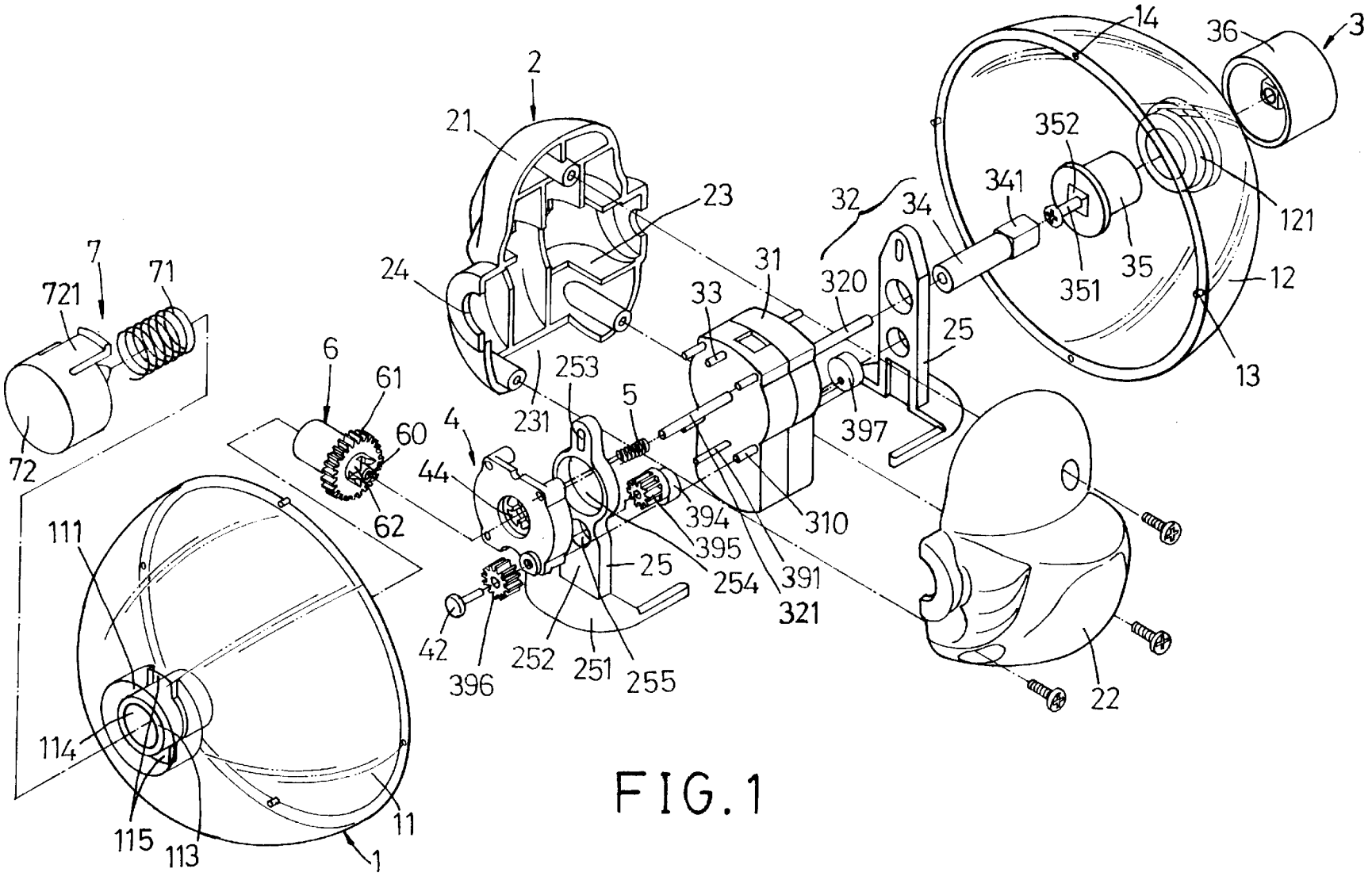
FIG. 1 is an exploded perspective view of a preferred embodiment of a self-propelling rolling toy according to the present invention.
Figure 2:
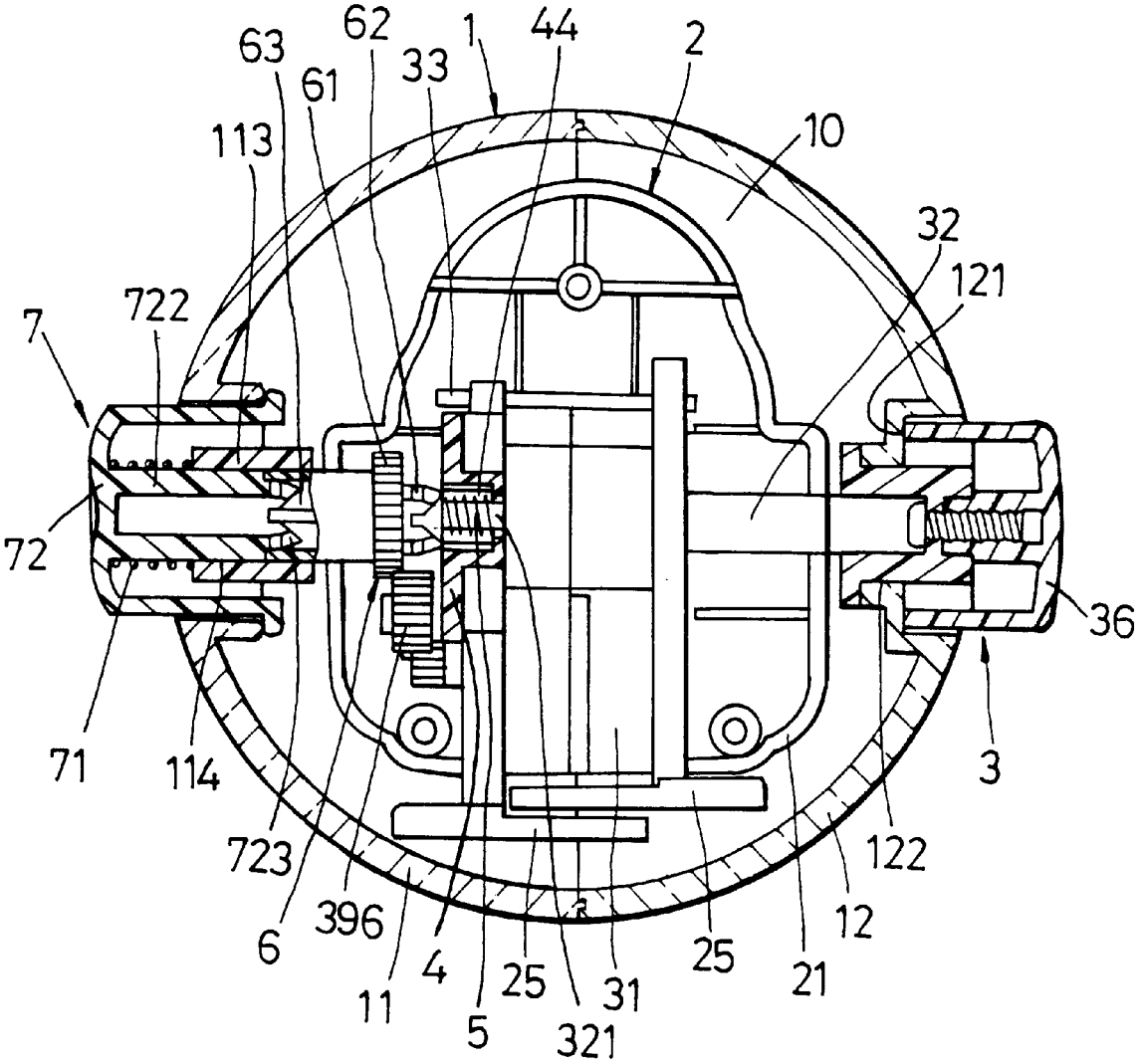
FIG. 2 is a vertical sectional view of the preferred embodiment, where a coupling rod is unlocked from an inner body of the preferred embodiment.

Referring to FIGS. 1 and 2, the preferred embodiment of a self-propelling rolling toy according to the present invention is shown to include a transparent spherical outer casing 1, an inner body 2, a coupling rod 6, a horizontal transmission shaft 32, clutch means 7 and a winding type driving unit 3.

The transparent spherical outer casing 1 includes complementary, generally semi-spherical first and second casing parts 11, 12 which are connected to one another via a plurality of engaging rods 13 and engaging holes 14, and which cooperatively confine an interior space 10 therebetween. The first casing part 11 has a central indention 111 which is formed with a tubular sleeve 113 that extends along an axis of the outer casing 1 and that confines an axial hole 114. The central indention 111 is further formed with two diametrically opposite openings 115 on opposite sides of the tubular sleeve 113. The second casing part 12 also has a central indention 121 which is formed with an axial hole 122 that is aligned with the axial hole 114 of the first casing part 11.

The inner body 2 includes complementary front and rear body parts 21, 22, and has an appearance in the form of an animal, such as a duck. The front and rear body parts 21, 22 cooperatively confine a receiving space 23, a bottom opening 231, and a horizontally extending through hole 24 registered with the axial holes 114, 122. The inner body 2 is provided with a spaced pair of leg members 25, each of which has an upright portion 252 substantially disposed in the receiving space 23, and a foot portion 251 that extends out of the receiving space 23 via the bottom opening 231. The upright portion 252 of each of the leg members 25 is formed with an upper vertically extending retaining slot 253, a lower cam engaging hole 255, and a mounting hole 254 between the retaining slot 253 and the cam engaging hole 255.

The inner body 2 is further provided a drive casing 31 disposed fixedly in the receiving space 23. The drive casing 31 has one side facing the first casing part 11 of the outer casing 1 and provided with four mounting projections 310. A retaining rod 33 extends through the drive casing 31, and has two opposite ends extending through the retaining slots 253 of the leg members 25 for mounting the leg members 25 to the inner body 2 while permitting upward and downward movement of the leg members 25.

Figure 3:
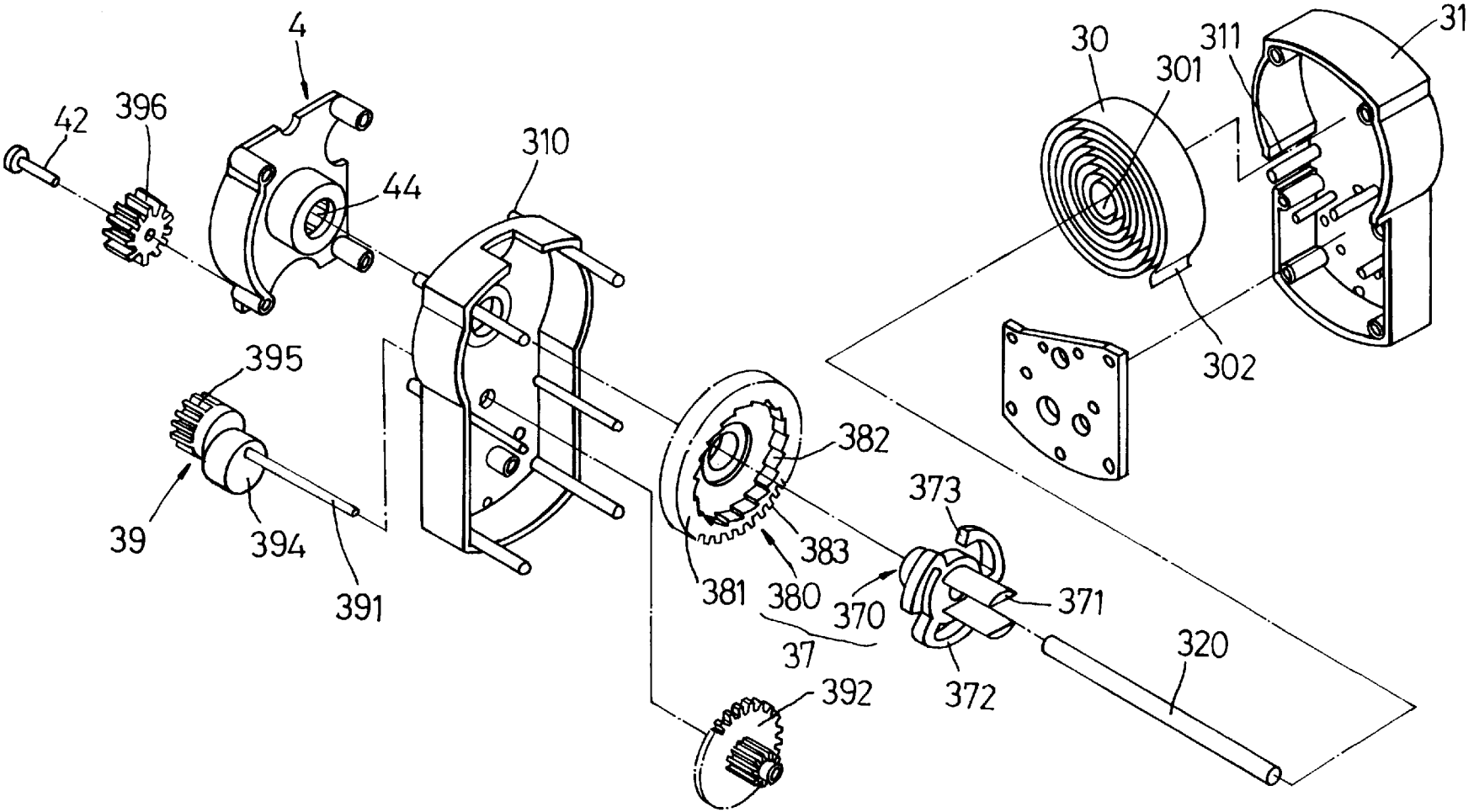
FIG. 3 is an exploded perspective view illustrating a winding-type driving unit of the preferred embodiment.

Referring to FIGS. 1 and 3, the transmission shaft 32 has a transmission section 320 extending rotatably through the through hole 24 of the inner body 2, the drive casing 31, and the central mounting holes 254 of the leg members 25 such that the inner body 2 is suspended rotatably thereon, and an operating section 34 which is fixed to the transmission section 320 and which has an operating end 341 with a rectangular cross-section. A rotary seat 35 is mounted rotatably on the central indention 121 of the second casing part 12, and has a rectangular coupling hole 352 coupled to the operating end 341 of the operating section 34 of the transmission shaft 32. A rotary knob 36 is mounted rotatably on the central indention 121 of the second casing part 12 at an outer side of the outer casing 1. The rotary knob 36 is fastened to the rotary seat 35 by means of a screw 351, and has an operating portion projecting outwardly from outer casing 1.

The winding-type driving unit 3 includes a spiral energy spring 30, a ratchet and pawl unit 37 and a gear set 39. The spiral energy spring 30 and the ratchet and pawl unit 37 are received in the drive casing 31. The spiral energy spring 30 has an outermost end 302 engaged within an engaging slot 311 formed in a wall of the drive casing 31, and an innermost end 301. The ratchet and pawl unit 37 includes a pawl member 370 and a ratchet wheel 380. The pawl member 370 has the transmission section 320 extending therethrough and mounted securely thereon. The pawl member 370 is formed with two insert legs 371 for coupling with the innermost end 301 of the spiral energy spring 30. The pawl member 370 is further formed with curved arms 372, each of which has a distal end formed with a pawl projection 373. The ratchet wheel 380 is disposed adjacent to the pawl member 370 and has the transmission section 320 extending rotatably therethrough. The ratchet wheel 380 is formed with an annular surrounding wall 381 that extends around the pawl member 370. The annular surrounding wall 381 has an inner surface formed with a plurality of ratchet teeth 382 therealong for engaging the pawl projections 373 on the pawl member 370 when the pawl member 370 is rotated in a certain direction, such as an anti-clockwise direction in FIG. 3. The annular surrounding wall 381 further has an outer surface formed with a plurality of engaging teeth 383 therealong. The gear set 39 includes a gear axle 391 mounted rotatably on the drive casing 31, and a coupling gear 392 mounted securely on the gear axle 391 inside the drive casing 31 and meshing with the engaging teeth 383 of the ratchet wheel 380. The gear axle 391 has two opposite ends that extend out of the drive casing 31 and that are provided with eccentric cam members 394, 397 which engage the leg members 25 at the cam engaging holes 255, respectively. The cam members 394, 397 are oriented in opposite directions on the gear axle 391.

The inner body 2 is further provided with a locking plate 4 which is disposed within the receiving space 23 and which is fixed to the drive casing 31 by means of the four mounting projections 310. The locking plate 4 is formed with an internally splined locking hole 44 which permits extension of a distal end part 321 (see FIG. 2) of the transmission section 320 of the transmission shaft 32 therethrough.

The left end of the gear axle 391 extends through the respective cam member 394 and the respective leg member 25, and has a first transmission gear 395 mounted securely thereon. The first transmission gear 395 meshes with a second transmission gear 396 that is mounted rotatably on the locking plate 4 by means of a pin 42. The first and second transmission gears 395, 396 constitute a transmission gear unit.

Figure 4:
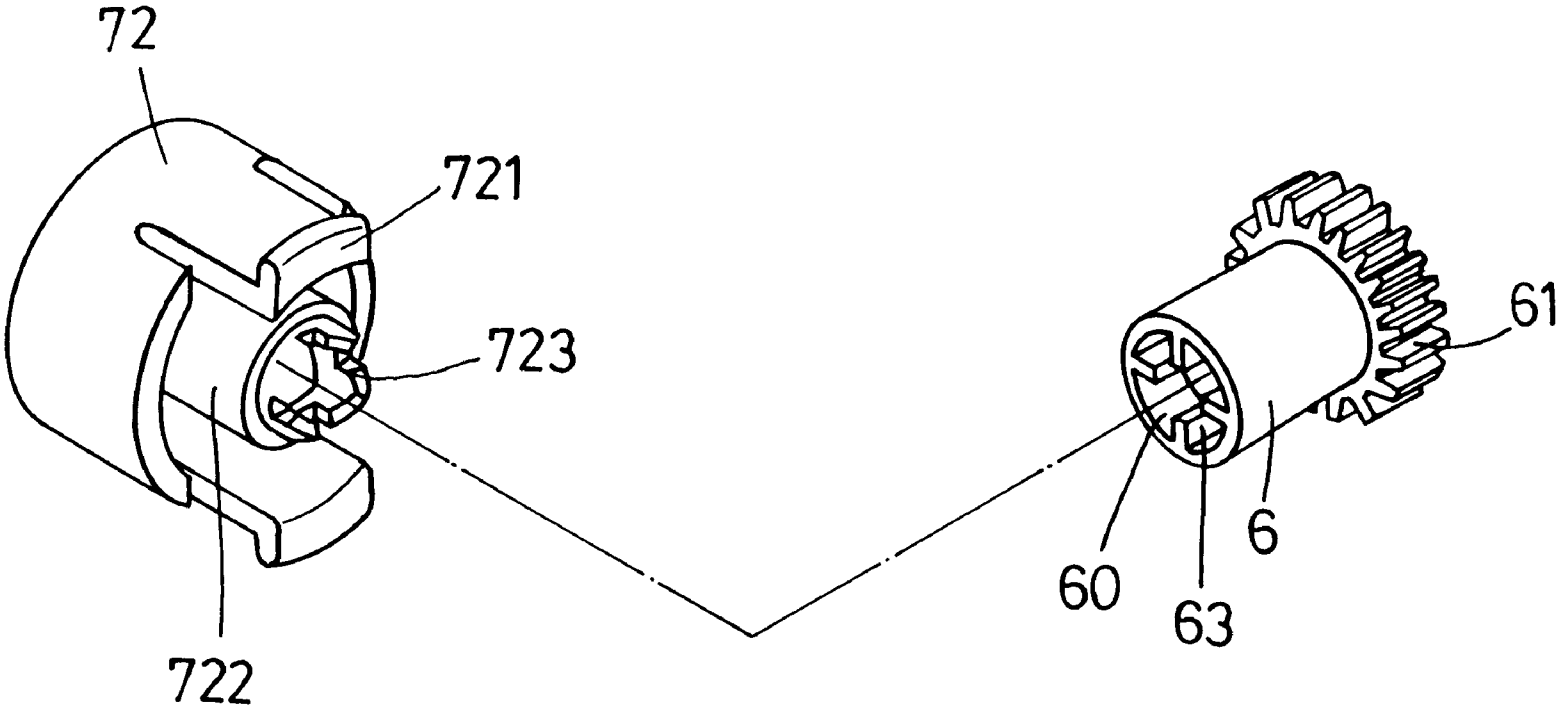
FIG. 4 is an exploded perspective view illustrating a coupling rod and a press member of the preferred embodiment.

Referring to FIGS. 1 and 4, the coupling rod 6 is disposed within the outer casing 1 adjacent to the central indention 111 of the first casing part 11, and is formed with an insert hole 60 to permit extension of the distal end part 321 of the transmission section 320 of the transmission shaft 32 thereinto so that the coupling rod 6 is slidable relative to the transmission shaft 32. The coupling rod 6 has a first end disposed adjacent to the central indention 111, and an opposite second end extending into the inner body 2 and disposed adjacent to the locking plate 4. The first end of the coupling rod 6 is tubular in shape and is formed with a plurality of inwardly projecting and axially extending radial ribs 63. The second end of the coupling rod 6 is formed with an externally splined tubular insert 62 for coupling selectively with the internally splined locking hole 44 of the locking plate 4. The coupling rod 6 is formed with a plurality of drive teeth 61 therearound between the first and second ends. The drive teeth 61 mesh slidably with the second transmission gear 396 that is mounted on the locking plate 4.

A biasing spring 5 is sleeved on the distal end part 321 of the transmission section 320 of the transmission shaft 32 between the drive casing 31 and the coupling rod 6. The biasing spring 5 normally biases the coupling rod 6 toward the first casing part 11 so that the externally splined tubular insert 62 does not extend into the locking hole 44, while maintaining engagement between the drive teeth 61 and the second transmission gear 396. The externally splined tubular insert 62 and the internally splined locking hole 44 thus constitute a locking unit for locking the coupling rod 6 to the locking plate 4, and thus to the inner body 2.

A press member 72 incorporating a spring 71 is mounted on the central indention 111 of the first casing part 11. The press member 72 is formed with two hooked insert legs 721 which extend slidably though the openings 115 in the central indention 111 and which engage the openings 115 to prevent relative rotation between the press member 72 and the outer casing 1. The press member 72 has a tubular push post 722 formed therein. The push post 722 has a coupling end portion formed with a plurality of axially extending coupling projections 723 which extend into the tubular first end of the coupling rod 6 to mesh with the ribs 63 for coupling the press member 72 non-rotatably to the coupling rod 6. As such, the coupling rod 6 is coupled non-rotatably to the outer casing 1 by virtue of the engagement between the ribs 63 and the coupling projections 723, and the engagement between the insert legs 721 and the openings 115. The spring 71 is sleeved on the push post 722 (see FIG. 2) for biasing the press member 72 outwardly when the press member 72 is not operated.

The press member 72, the biasing spring 5, and the locking unit including the externally splined tubular insert 62 and the internally splined locking hole 44, cooperatively constitute the clutch means 7. When the press member 72 is pressed, the coupling rod 6 is pushed by the push post 722 to move toward the inner body 2 so that the tubular insert 62 extends into and engages the locking hole 44, thereby compressing the biasing spring 5. When the press member 72 is released, the biasing spring 5 expands to move the coupling rod 6 away from the inner body 2 so that the tubular insert 62 disengages the locking hole 44, while maintaining engagement between the drive teeth 61 of the coupling rod 6 and the second transmission gear 396.

Figure 5:
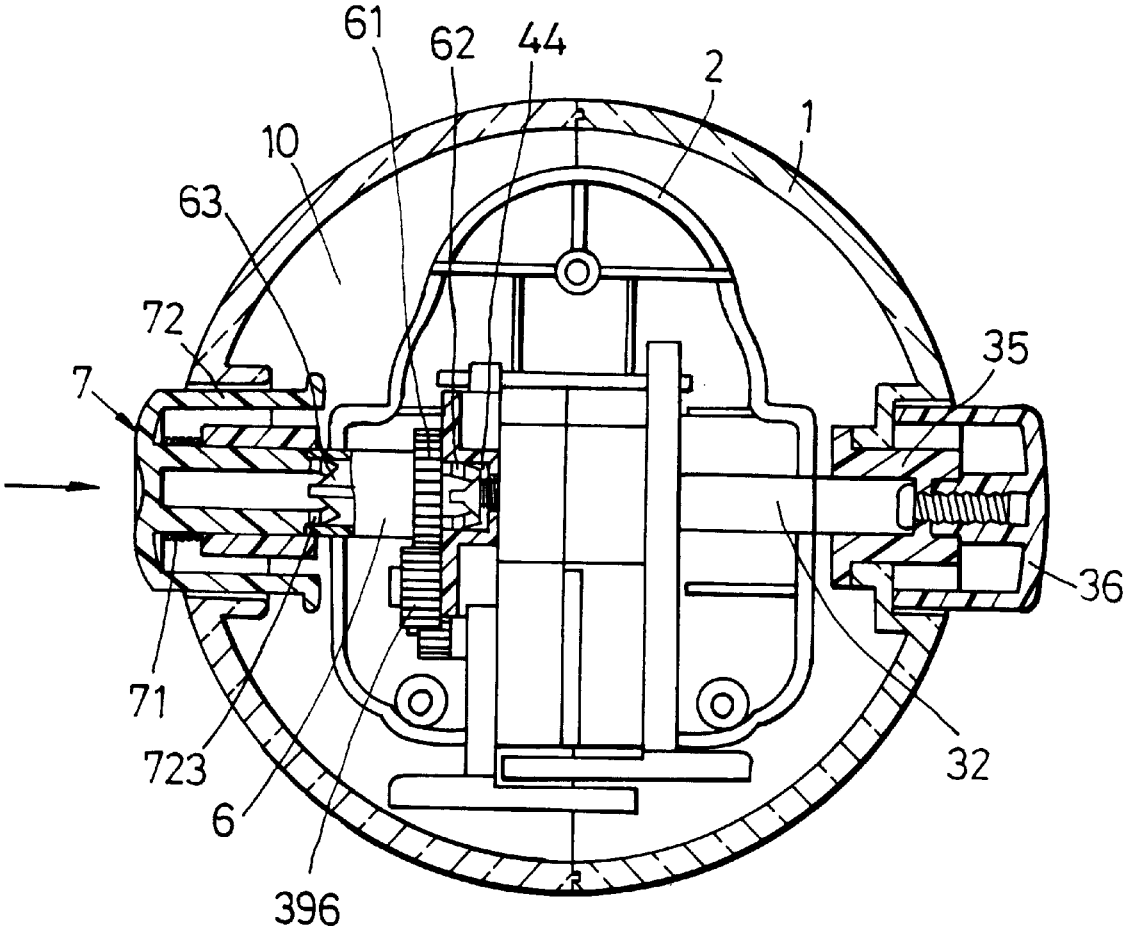
FIG. 5 is a vertical sectional view of the preferred embodiment, where a coupling rod is locked to the inner body of the preferred embodiment.

Referring to FIGS. 1, 3, and 5, to operate the toy, the press member 72 is operated so that the tubular insert 62 of the coupling rod 6 moves into the locking hole 44 in order to lock the inner body 2 to the coupling rod 6, thereby locking the inner body 2 to the outer casing 1. When the rotary knob 36 is rotated to rotate the transmission shaft 32 in a first direction, such as a clockwise direction in FIG. 3, while the outer casing 1 is held by the user, the pawl member 370 rotates together with the transmission shaft 32 in the clockwise direction. Since the insert legs 371 of the pawl member 370 are coupled to the innermost end 301 of the spiral energy spring 30, and since the outermost end 302 of the spiral energy spring 30 is fixed to the drive casing 31, which, in turn, is fixed to the inner body 2 that is locked to the outer casing 1 at this time, rotation of the transmission shaft 32 results in winding of the spiral energy spring 30 for storing operating energy. Since the pawl projections 373 of the pawl member 370 do not engage the ratchet teeth 382 on the ratchet wheel 380 during rotation in the clockwise direction, rotation of the transmission shaft 32 is prevented from being transmitted to the coupling rod 6 via the coupling gear 392, the gear axle 391, and the transmission gears 395, 396. When rotation of the rotary knob 36 is stopped, the pawl projections 373 of the pawl member 370 engage the ratchet teeth 382 on the ratchet wheel 380. At this time, since the ratchet wheel 380 meshes with the gear set 39, which meshes with the coupling rod 6 that, in turn, is coupled non-rotatably to the outer casing 1, and since the outer casing 1 is held by the user, the outer casing 1, the coupling rod 6, the gear set 39 and the ratchet wheel 380 are prevented from rotation. As such, the pawl member 370 and the transmission shaft 32 mounted thereon are prevented from rotation to prevent unwinding of the spiral energy spring 30. The spiral energy spring 30 can thus be continuously wound until a sufficient amount of operating energy has been stored in the spiral energy spring 30.

Referring again to FIGS. 1, 2 and 3, after a sufficient amount of operating energy has been stored, the press member 72 of the clutch means 7 is released so that the biasing spring 5 expands to push the coupling rod 6 away from the inner body 2 and to disengage the tubular insert 62 from the locking hole 44, thereby unlocking the inner body 2 from the coupling rod 6, and thus from the outer casing 1. At this time, the stored operating energy of the spiral energy spring 36 urges the pawl member 370 to rotate in a second direction opposite to the first direction, such as in an anti-clockwise direction in FIG. 3. Under this situation, the pawl projections 373 of the pawl members 370 engage the ratchet teeth 382 of the ratchet wheel 380 to cause rotation of the ratchet wheel 380, thereby causing corresponding rotation of the coupling gear 392, the gear axle 391 and the first and second transmission gears 395, 396. Since the drive teeth 61 of the coupling rod 6 mesh with the second transmission gear 396, and since the coupling rod 6 is coupled non-rotatably to the outer casing 1, which has been unlocked from the inner body 2, the coupling rod 6 rotates together with the second transmission gear 396 to cause corresponding rotation of the outer casing 1 relative to the inner body 2. When placed on a smooth ground surface, the outer casing 1 is thus capable of rolling movement thereon. Since the opposite ends of the gear axle 391 are mounted with the eccentric cam members 394, 397 that engage the leg members 25, rotation of the gear axle 391 results in alternating upward and downward movement and alternating forward and rearward movement of the leg members 25 relative to the inner body 2 to generate a simulated walking movement of the inner body 2 in the rolling outer casing 1. In practice, the inner body 2 is designed to have a sufficient weight such that the force required for rotating the inner body 2 about the transmission shaft 32 inside the outer casing 1 is substantially greater than the force required for rolling movement of the outer casing 1 on the smooth ground surface. As such, the inner body 2 can be maintained in a substantially upright orientation when the outer casing 1 rolls on a ground surface.

When an obstacle is encountered by the toy during rolling movement of the outer casing 1 on the ground surface to resist rotation of the outer casing 1, rotation of the coupling rod 6 and the gear set 39 is resisted correspondingly, thereby stopping rotation of the ratchet wheel 380 and the pawl member 370. At this time, since the outermost end of the spiral energy spring 30 is coupled to the drive casing 31 that is mounted fixedly in the inner body 2 which has been unlocked from the outer casing 1, the operating energy of the spiral energy spring 30 causes the drive casing 31 to rotate about the transmission shaft 32 for unwinding the spiral energy spring 30, thereby causing rotation of the inner body 2 in the outer casing 1 about the transmission shaft 32. Rotation of the inner body 2 results in a change in the weight center of the inner body 2, and thus results in a change in the route of rolling movement of the outer casing 1 to enable the outer casing 1 to move away from the obstacle for continued rolling movement on the ground surface.

With this invention thus explained, it is apparent that numerous modifications and variations can be made without departing from the scope and spirit of this invention. It is therefore intended that this invention be limited only as indicated in the appended claims.

We claim:

1. A self-propelling rolling toy comprising:

a transparent spherical outer casing;

a coupling rod provided in and coupled non-rotatably to said outer casing;

a horizontal transmission shaft mounted rotatably in said outer casing along an axis of said outer casing, said transmission shaft having an operating end that is operable from an outer side of said outer casing;

an inner body mounted rotatably on said transmission shaft inside said outer casing;

clutch means provided on said inner body and said coupling rod, and operable to lock selectively said inner body to said coupling rod; and a winding-type driving unit disposed in said inner body and including a spiral energy spring which has an innermost end coupled to said transmission shaft and an outermost end coupled to said inner body, a ratchet and pawl unit provided on said transmission shaft, and a gear set which couples said ratchet and pawl unit and said coupling rod;

said ratchet and pawl unit preventing rotation of said transmission shaft from being transmitted to said coupling rod when said operating end of said transmission shaft is rotated in a first direction while said clutch means locks said inner body to said coupling rod to permit winding of said spiral energy spring for storing operating energy;

said ratchet and pawl unit permitting rotation of said transmission shaft in a second direction opposite to the first direction due to the operating energy of said spiral energy spring to be transferred to said outer casing via said gear set and said coupling rod to result in rotation of said outer casing relative to said inner body and in rolling movement of said outer casing when said outer casing is placed on a ground surface while said clutch means unlocks said inner body from said coupling rod;

resistance to rotation of said outer casing relative to said inner body while said clutch means unlocks said inner body from said coupling rod resulting in rotation of said inner body in said outer casing about said transmission shaft due to the operating energy of said spiral energy spring.

2. The self-propelling rolling toy as claimed in claim 1, wherein said clutch means includes:

a locking unit provided on said inner body and said coupling rod for locking releasably said inner body to said coupling rod;

a biasing spring provided in said inner body for biasing said coupling rod away from said inner body such that said locking unit normally unlocks said inner body from said coupling rod; and a press member mounted on and extending into said outer casing, said press member being operable to push said coupling rod against action of said biasing spring to enable said locking unit to lock said inner body to said coupling rod, and to permit expansion of said biasing spring such that said locking unit unlocks said inner body from said coupling rod.

3. The self-propelling rolling toy as claimed in claim 2, wherein said coupling rod has a first end disposed adjacent to said press member, and an opposite second end extending into said inner body, said locking unit including an externally splined tubular insert formed on said second end of said coupling rod, and an internally splined locking hole formed in said inner body, said coupling rod moving toward said inner body against action of said biasing spring so that said tubular insert engages said locking hole to lock said inner body to said coupling rod when said press member is operated, said coupling rod being moved away from said inner body by said biasing spring so that said tubular insert disengages said locking hole to unlock said inner body from said coupling rod when said press member is released.

4. The self-propelling rolling toy as claimed in claim 3, wherein said press member is mounted non-rotatably and slidably on said outer casing, said press member having a coupling end portion formed with axially extending coupling projections, said first end of said coupling rod being tubular in shape and being formed with a plurality of inwardly projecting and axially extending radial ribs which engage said coupling projections for mounting said coupling rod non-rotatably to said press member, thereby mounting said coupling rod non-rotatably to said outer casing.

5. The self-propelling rolling toy according to claim 4, wherein said press member is formed with two insert legs, said outer casing being formed with two openings, said insert legs extending slidably through and engaging said openings for mounting non-rotatably said press member on said outer casing.

6. The self-propelling rolling toy as claimed in claim 1, wherein said ratchet and pawl unit includes: a pawl member mounted securely on said transmission shaft and provided with a pawl projection; and a ratchet wheel mounted rotatably on said transmission shaft adjacent to said pawl member and formed with an annular surrounding wall extending around said pawl member, said annular surrounding wall being formed with a plurality of ratchet teeth therealong for engaging said pawl projection on said pawl member when said transmission shaft rotates in the second direction, and engaging teeth for meshing with said gear set.

7. The self-propelling rolling toy as claimed in claim 6, wherein said coupling rod is formed with drive teeth, said gear set including:

a gear axle mounted rotatably in said inner body;

a coupling gear mounted securely on said gear axle inside said inner body and meshing with said engaging teeth of said ratchet wheel; and a transmission gear unit coupled to said gear axle and said drive teeth of said coupling rod for transmitting rotation of said gear axle to said coupling rod.

8. The self-propelling rolling toy as claimed in claim 7, wherein said inner body is provided with a spaced pair of leg members that are movable upwardly and downwardly thereon, said gear axle having opposite ends provided with eccentric cam members that engage said leg members to result in alternating upward and downward movement of said leg members relative to said inner body when said gear axle rotates.

9. The self-propelling rolling toy as claimed in claim 1, wherein said operating end of said transmission shaft has a non-circular cross-section, said toy further comprising a rotary knob which is mounted rotatably on said outer casing and which has an operating portion disposed outside said outer casing, said rotary knob being formed with a non-circular hole engaging said operating end such that said transmission shaft is co-rotatable with said rotary knob.

* * * * *